US005373603A

United States Patent [19]

Stegens

[11] Patent Number: 5,373,603

[45] **Date of Patent: * Dec. 20, 1994**

[54] BRUSHROLL

[75] Inventor: Alfred H. Stegens, Olmsted Township, Ohio

[73] Assignee: The Scott Fetzer Company, Westlake, Ohio

[ * ] Notice: The portion of the term of this patent subsequent to Dec. 28, 2010 has been disclaimed.

[21] Appl. No.: 167,225

[22] Filed: Dec. 14, 1993

Related U.S. Application Data

[63] Continuation of Ser. No. 998,791, Dec. 29, 1992, Pat. No. 5,272,785, which is a continuation-in-part of Ser. No. 887,420, May 20, 1992, Pat. No. 5,193,242, which is a continuation of Ser. No. 456,348, Dec. 26, 1989, abandoned.

[51] Int. Cl.[5] ..... A46B 13/02

[52] U.S. Cl. ..... 15/179; 15/41.1; 15/391; 15/392; 384/489; 492/29; 492/47

[58] Field of Search ..... 15/41.1, 42–46, 15/48, 48.1, 48.2, 179, 182, 383, 384, 389, 391, 392; 384/489; 492/29, 47

[56] References Cited

U.S. PATENT DOCUMENTS

| | | | |
|---|---|---|---|
| 600,413 | 3/1898 | Drew . | |
| 1,104,270 | 7/1914 | Pack . | |
| 1,286,321 | 12/1918 | Hoover . | |
| 1,582,652 | 4/1926 | Albrecht . | |
| 1,599,991 | 9/1926 | Demarec . | |
| 1,680,741 | 8/1928 | Lang . | |
| 1,681,453 | 8/1928 | Wright . | |
| 1,815,084 | 7/1931 | White . | |
| 1,878,856 | 9/1932 | Jones | 15/179 |
| 1,891,503 | 12/1932 | Smellie . | |
| 1,919,067 | 7/1933 | Lang . | |
| 1,972,796 | 9/1934 | Schaad . | |
| 1,973,679 | 9/1934 | Bass | 15/179 |
| 1,999,696 | 4/1935 | Kitto . | |
| 2,014,626 | 9/1935 | Moorhead . | |
| 2,055,264 | 9/1936 | Schottle . | |
| 2,176,769 | 10/1939 | Martinet . | |
| 2,263,762 | 11/1941 | Dow et al. . | |

(List continued on next page.)

FOREIGN PATENT DOCUMENTS

| | | |
|---|---|---|
| 561960 | 5/1960 | Belgium . |
| 1102107 | 7/1952 | France . |
| 228076 | 3/1909 | Germany . |
| 3039167 | 5/1982 | Germany . |
| 671202 | 10/1964 | Italy . |
| 52-46671 | 10/1975 | Japan . |
| 390746 | 8/1965 | Switzerland . |
| 002628 | of 1898 | United Kingdom . |
| 027325 | of 1907 | United Kingdom . |
| 1206844 | 9/1970 | United Kingdom . |
| 2086717 | 5/1982 | United Kingdom . |

*Primary Examiner*—Mark Spisich
*Attorney, Agent, or Firm*—Watts, Hoffmann, Fisher & Heinke

[57] ABSTRACT

A vacuum cleaner brushroll including a tufted spindle supported by end assemblies having bearings that rotatably mount the spindle in the vacuum cleaner nozzle. The brushroll includes a spindle and improved end assemblies for supporting the spindle comprising a first member fixed to an end of the spindle, a relatively rotatable second member having a portion that is adapted to mate with mounting structure in the vacuum cleaner nozzle, a bearing which is supported by the second member and in turn supports the first member and stub shaft structure for coupling the first member with the bearing. Either the first or second member has a pair of annular walls that are radially spaced apart to define an annular channel, while the other member has an annular skirt that extends into the annular channel to form a labyrinth thread seal. The stub shaft structure may be integral with the second member and may include reinforcing shafts or inserts for strengthening the first member against bending due to the force of the drive belt.

5 Claims, 6 Drawing Sheets

U.S. PATENT DOCUMENTS

| | | | |
|---|---|---|---|
| 2,271,553 | 2/1942 | Smellie | 15/182 |
| 2,281,863 | 5/1942 | Smellie | 15/182 |
| 2,372,404 | 3/1945 | Taylor | 15/179 |
| 2,707,792 | 5/1955 | Waller | 15/182 |
| 2,734,211 | 2/1956 | Vance | 15/183 |
| 3,198,318 | 8/1965 | Brown . | |
| 3,259,442 | 7/1966 | Boghosian . | |
| 3,284,830 | 11/1966 | Kroll . | |
| 3,346,896 | 10/1967 | Arones . | |
| 3,368,231 | 2/1968 | Kravos et al. | 15/344 |
| 3,521,932 | 7/1970 | Beebe . | |
| 3,550,974 | 12/1970 | Kupchick . | |
| 3,566,497 | 3/1971 | Hamlen . | |
| 3,774,982 | 11/1973 | Nakamura et al. . | |
| 3,833,961 | 9/1974 | Fortman et al. . | |
| 3,879,786 | 4/1975 | Larkin . | |
| 3,959,847 | 6/1976 | Kaulig et al. . | |
| 4,130,911 | 12/1978 | Clark | 15/179 |
| 4,209,872 | 7/1980 | Maier | 15/179 |
| 4,209,873 | 7/1980 | Schaefer | 15/182 |
| 4,361,929 | 12/1982 | Jinkins . | |
| 4,373,759 | 2/1983 | Greener et al. . | |
| 4,403,372 | 9/1983 | Keane et al. | 15/339 |
| 4,429,430 | 2/1984 | Lyman | 15/182 |
| 4,527,915 | 7/1985 | Ikarijshi et al. . | |

BRUSHROLL

RELATED APPLICATIONS

This application is a continuation application of Ser. No. 07/998,791, filed Dec. 29, 1992, now U.S. Pat. No. 5,272,785, which is a continuation-in-part application of Ser. No. 07/887,420, filed May 20, 1992, now U.S. Pat. No. 5,193,242, which is a continuation of Ser. No. 07/456,348, filed Dec. 26, 1989, now abandoned.

TECHNICAL FIELD

The present invention relates generally to vacuum cleaners, and more specifically to a vacuum cleaner brushroll including an improved end assembly having a labyrinth seal for preventing fouling of the brushroll bearings by threads picked up from the carpet. The brushrolls are characterized by, among other features, ease of fabrication and assembly of its components.

BACKGROUND ART

Prior art brushrolls generally include a central spindle supported at either end by bearings mounted on the sides of the nozzle. The spindles are turned by belts tied to a vacuum cleaner motor, either directly or through one or more pulleys. Mounted on the elongated surface of the spindle is a plurality of tufts of bristles or beater bar elements projecting normally from the surface of the spindle. As the brushroll rotates, the tufts or beater bar elements brush against the surface of the carpet and loosen dirt from the fibres. The tufts or beater bar elements are generally mounted in a helical pattern on the brushroll so as to agitate the carpet seriatim as the vacuum cleaner moves over the carpet surface.

In practice, dirt and threads loosened by the brushroll can flow along the surface of the roll toward its ends into the bearings at the sides. As a result, the bearings can foul so that the brushroll cannot turn freely in response to the belt drive.

A number of thread guards have been proposed for preventing threads from fouling the brushroll bearings. These proposed thread guards include labyrinth seals which fit over the ends of the spindle in an effort to prevent threads moving outwardly along the spindle from reaching the bearing. One drawback to these thread guards is that they tend to be complicated and expensive to manufacture. Many do not lend themselves to modern manufacturing methods such as injection molding from plastic. There remains a need in the art for a brushroll which is simple and relatively inexpensive to fabricate and assemble.

SUMMARY OF THE INVENTION

The present invention provides a vacuum cleaner brushroll assembly which prevents threads picked up during cleaning from fouling the brushroll bearing. The brushroll includes a tufted spindle supported by end assemblies having bearings that rotatably mount the spindle in the vacuum cleaner nozzle. Rotation of the spindle is effective to pick up dirt, lint, threads and the like that tend to move along the spindle toward the bearings at its ends. One feature of the invention is an improvement to the end assemblies in which the bearing is surrounded by a labyrinth thread seal to protect it from material picked up by rotation of the spindle.

According to one embodiment, an improved end assembly comprises a first member fixed to an end of the spindle and a relatively rotatable second member having a portion that is adapted to mate with mounting structure in the vacuum cleaner nozzle. One of the members has a pair of annular walls that are radially spaced apart to define an annular channel. The other of the members has an annular skirt that extends into that annular channel form the labyrinth thread seal. When the first member has the pair of annular walls defining the channel and the second member has the skirt extending into the member, the labyrinth seal opens axially outwardly to further inhibit the flow of threads, dirt and lint toward the bearing.

The end assembly also includes stub shaft structure extending axially inwardly past the first member into fixed frictional engagement within a hole in the end of the spindle. The bearing includes relatively rotatable first and second portions. The first portion is fixed on the stub shaft structure. The second portion is fitted in a bearing pocket in the second member so that the first and second members may rotate relative to each other. When assembled in this manner, the bearing is protected within the labyrinth thread seal defined by the first and second members from threads, dirt and lint carried along the surface of the spindle toward its ends.

The stub shaft structure may take several forms. In one form, the stub shaft structure includes a metallic stub shaft which extends through the first member and frictionally engages in an axial hole in an end of the spindle. In this form, the stub shaft may include a collar which presses against the first member to hold it in place. In another form, the first member is an integral structure including the stub shaft structure and a flange on which the walls or skirt are supported. In this form, a reinforcing pin insert may be provided in a bore extending into the end portion of the stub shaft structure fixed to the first portion of the bearing to support the first member against bending due to the pull of a drive belt against the spindle. In yet another form, the stub shaft structure includes structure on the first member frictionally engaged in the axial hole in the end of the spindle and a reinforcing shaft. The reinforcing shaft has an insert portion frictional engaged in the first member within the axial hole.

The brushroll also includes tufts carried by the spindle. In one embodiment, each tuft mounted on the spindle is angled toward one end of the spindle or the other to encourage the flow of threads towards the ends of the spindle. The angles which the tufts make with a normal to the axis of the spindle increase with increasing distance from the center of the spindle. Furthermore, the second member may include a spool axially outward of the first member for capturing pieces of thread which flow outwardly past the second member. Since the spool is located outwardly of the second member, it is easily accessible for removing the captured threads.

The brushroll is characterized by ease of fabrication and assembly. Many of the components may be formed from injection molded plastic. Reinforcing inserts are provided where the plastic itself does not have sufficient strength or bending resistance. The components of the end assemblies are secured together by friction, and may be assembled quickly and easily.

Alternatively, a simplified brushroll dispensing of the need for the first member comprises a spindle and end assemblies each having a stub shaft, bearing and end member. Each end of the spindle has an integral annular skirt which extends axially into an annular channel defined by a pair of annular wall portions of the end member to define a labyrinth seal. The stub shafts frictionally engage in axial holes in the ends of the spindles. Relatively rotatable portions of the bearing are fixed to a bearing-mounting portion of the stub shaft and in a bearing-receiving pocket in the end member. This simplified brushroll has the advantage of relatively few parts to be assembled and is well-suited to fabrication by injection molding techniques.

Still other features and advantages and a full understanding of the invention will become apparent to those skilled in the art from the following description of the preferred embodiment of the invention and the accompanying drawings.

DETAILED DESCRIPTION OF THE PREFERRED EMBODIMENTS

Figure 1:
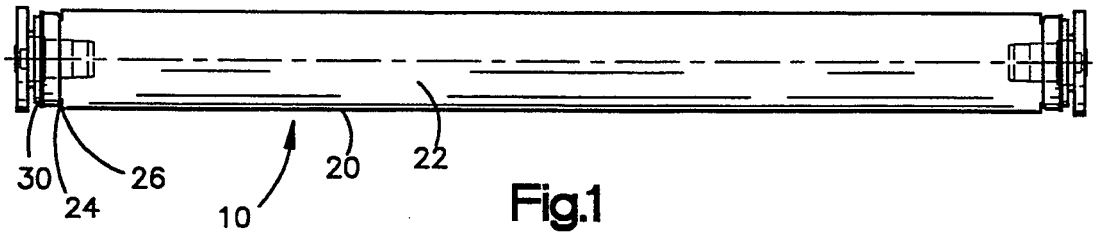
FIG. 1 is a side elevational view showing a brushroll according to the present invention with tufts omitted for clarity.

A brushroll 10 according to the present invention is illustrated in FIG. 1. As shown in FIG. 1, the brushroll 10 consists of a spindle 20 rotatably supported at each end by end assemblies 30. Each end assembly 30 is mounted on a vacuum cleaner nozzle (not shown) to position the brushroll 10.

In one embodiment, the spindle 20 is made of wood and consists of a main portion 22 and two reduced diameter portions or necks 24 at either end of the spindle 20. The necks 24 meet the main portion 22 to form shoulders 26. A round blind hole 28 is drilled into each end of the spindle 20.

Figure 2:
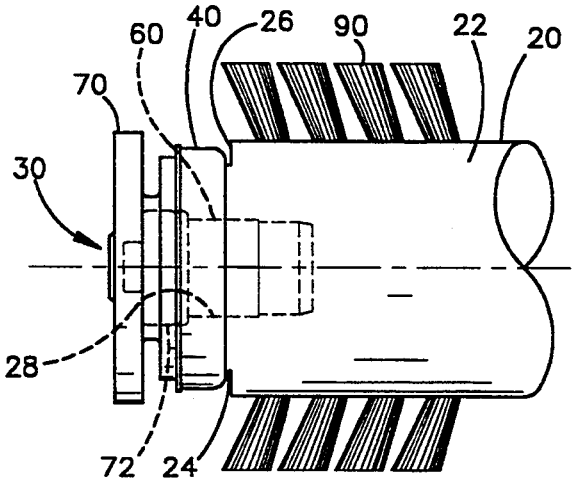
FIG. 2 is an enlarged fragmentary elevational view of one end of the brushroll of FIG. 1.
Figure 3:
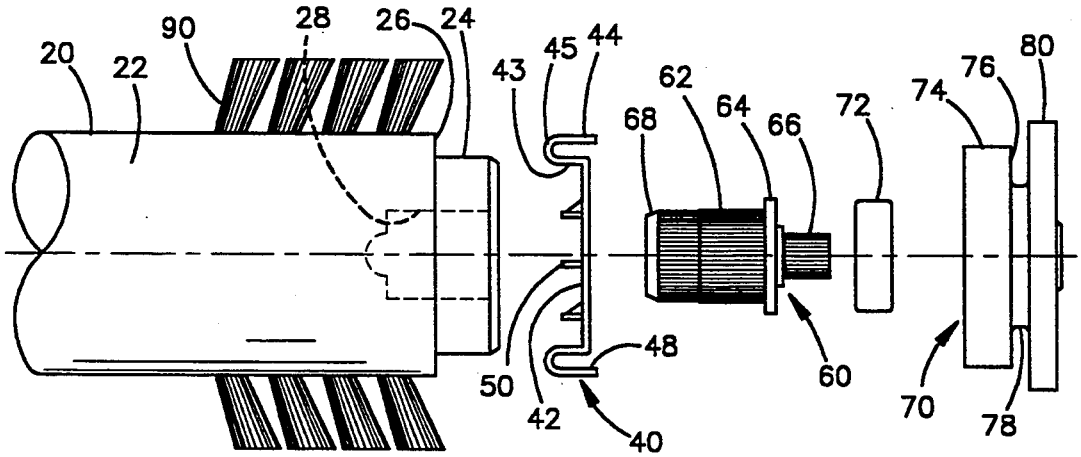
FIG. 3 is an exploded view of an end assembly of the brushroll of FIG. 1.
Figure 4:
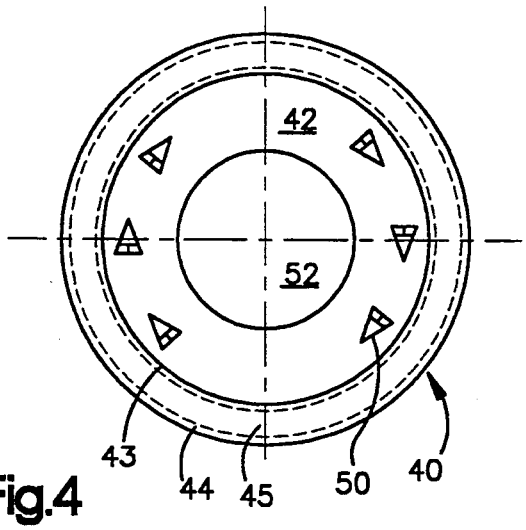
FIG. 4 is an end elevational view of a first member in the end assembly of FIG. 3.

As best shown in FIGS. 2 and 3, each end assembly 30 according to the present invention comprises a thread guard or first member 40, shouldered stub shaft structure 60, a bearing 72 and a second member 70. The first member 40, which as shown in FIGS. 3 and 4 takes the form of a ferrule, is a steel stamping comprising an inner web portion 42 and a pair of annular wall portions 43, 44. The inner annular wall portion 43 is bent at 90° to the inner web portion 42, and is joined by a flange 45 to the reversely bent, outer annular wall portion 44. The annular wall sections 43, 44 are radially spaced to define an annular channel 48. The inner annular wall portions 43 fit over the necks 24 at either end of the spindle 20 and are held in place by tangs 50 cut out from the inner web portion 42. A hole 52 is formed in the inner web portion 42 and aligns with the hole 28 when the thread guard is fitted the adjacent neck 24.

The stub shaft structure 60 shown in FIG. 3 is an integral steel member comprising a stub Portion 62, a collar 64 and a reduced diameter bearing-mounting ,portion 66. The stub portion 62 is sized to form a close fit when pushed into the hole 28 in the spindle 20. The surface of the stub portion 62 is knurled in order to increase the frictional engagement between the stub portion 62 and the hole 28. Likewise, the bearing-mounting portion 66 is preferably knurled. The stub portion 62 is preferably chamfered as at 68 in order to center the shaft 60 with the spindle 20 when the stub portion 62 is pushed into the hole 28.

During assembly, the first member 40 is forced over the end portion 24 of the spindle 20 and the stub portion 62 of the structure 60 is pressed into the hole 28. The collar 64 of the shaft 60 has a larger outer diameter than the hole 52 in the first member 40 and holds the first member 40 against the adjacent neck 24 of the spindle 20. At the same time, the annular wall portion 43 of the first member 40 surrounds the neck 24 of the spindle 20 so that the stub portion 62 remains in frictional engagement with the bore 28 if the adjacent neck 24 expands.

Figure 5:
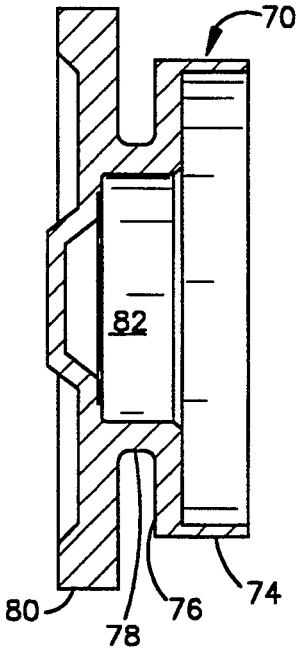
FIG. 5 is an enlarged sectional view of a second member of the end assembly of FIG. 3;.

Outward of the first member 40 is the second member 70. The second member 70 as shown in FIG. 5 is a unitary plastic molding comprising a peripheral skirt 74, an inner flange 76, a spool 78 and an outer flange 80. The peripheral skirt 74 is of a suitable axial length to extend into the channel 48 of the adjacent first member 40. The outer race of the ball bearing 72 is press fitted into a pocket 82 in the second member 70 and the bearing-mounting portion 66 of the stub shaft structure 60 is press fitted into the inner race of the ball bearing 72 in order to provide support for the spindle 20 and the first member 40.

The first annular wall portion 44 of the first member 40 has substantially the same outer diameter as the main portion 22 of the spindle 20 so that threads working their way axially outwardly flow over the first member 40 and the peripheral skirt 74 of the second member 70 onto the spool 78. Threads flowing onto the spool 78 are trapped on the spool 78 and prevented from flowing back toward the seal formed by the first member 40 and the second member 70 by the inner flange 76. The threads trapped on the spool 78 may be removed during routine maintenance of the vacuum cleaner.

The brushroll 10 featuring the second member 70 as illustrated in FIG. 5 is mounted on a vacuum cleaner nozzle (not shown) by sliding the outer flange 80 into slots on the side of the nozzle. In operation, the brushroll 10 is driven by a belt (not shown) which may engage a slot (not shown) on the brushroll 10.

The spindle 20 carries two helical rows of tufts 90 which agitate the carpet as the brushroll 10 turns in order to loosen dirt in the carpet. The tufts 90 as shown in FIGS. 2 and 3 are angled toward the ends of the spindle 20 to encourage the flow of threads toward the spools 78 at either end of the brushroll 10.

Figure 6:
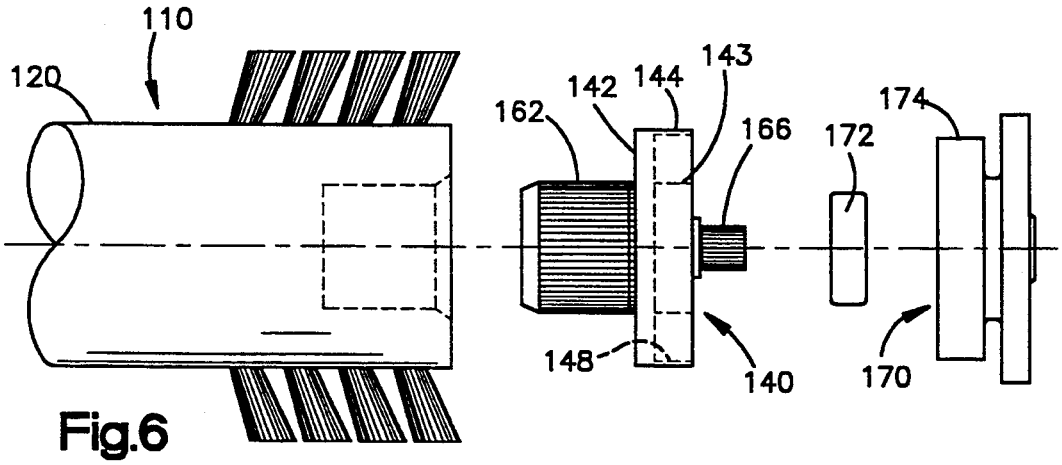
FIG. 6 is an exploded view of an end section of another brushroll end assembly.

In a modified brushroll 110 designed for ease of construction when using a plastic spindle 120, the stub shaft structure forms a part of an integral first member. As shown in FIG. 6, a modified first member 140 is an injection molding which comprises a stub portion 162, a flange 142 and a reduced diameter bearing-mounting portion or neck 166 for engaging an inner race of a bearing 172. The flange 142 mounts a pair of radially spaced annular wall portions 143, 144 which define an annular channel 148. The second member 170 of the modified brushroll 110 has the same structure as the second member 70 of the preferred brushroll 10 shown in FIGS. 3 and 5. When assembled, a peripheral skirt 174 projecting from the second member 170 extends into the channel 148 defined by the annular wall portions 143, 144 of the modified first member 140 to form a labyrinth seal.

Figure 7:
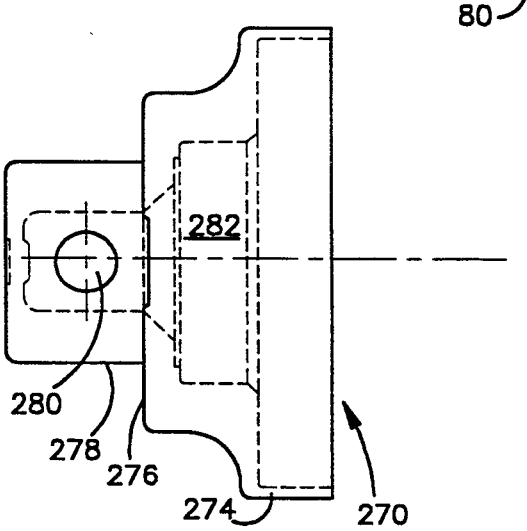
FIG. 7 is a side elevational view of a modified second member for the modified end assembly of FIG. 6.

A modified second member 270 for use with either the brushroll 10 of FIGS. 1, 2 and 3 or the modified brushroll 110 of FIG. 6 is shown in FIG. 7. The modified second member 270 comprises an peripheral skirt 274, an inner flange 276, a spool 278 and screw 280. When assembled, a bearing such as the ball bearings 72 of FIG. 3 and 172 of FIG. 6 may be press fitted into a pocket 282 of the modified second member 270. The peripheral skirt 274 extends into the channel 48 or 148 so that threads moving axially outwardly along the brushroll 10 or 110 flow over the peripheral skirt 274 onto the spool 278 and are trapped behind the screw 280. The trapped threads are then retained on the spool 278 between the inner flange 276 and the stop screw 280 until removed. The screw 280 also cooperates with structure on the inner surface of the vacuum cleaner nozzle (not shown) to mount the brushroll 10 or 110 in the nozzle.

An end of a second modified brushroll 310 is shown in FIGS. 8–11. Like the brushroll 110 of FIG. 6, the stub shaft structure of the brushroll 310 forms a part of an integral first member. The brushroll 310 comprises a spindle 320, the first member 340, a second member 370, a bearing 372 and a reinforcing pin insert 400. The first member 340 is an integral plastic molding including a stub portion 362 for close-fitting engagement with a hole 328 in an end of the spindle 320, an inner flange portion 341, an outer flange portion 342, a peripheral skirt 344 and a bearing-mounting portion or neck 366 for engaging the bearing 372. The stub portion 362 and bearing-mounting portion 366 are knurled to increase the frictional engagement of the first member 340 with the spindle 320 and the bearing 372, and the stub portion 362 is chamfered to help center the stub portion 362 in the hole 328 as the brushroll is assembled. Unlike the spindle 20, the spindle 320 of embodiment 310 does not have reduced diameter neck portions at its ends, but instead has cavity 329 into which the inner flange 341 of the first member 340 is inserted.

The second member 370 includes an outer lip portion 373, an outer annular wall portion 374, an end flange portion 376 including means 377 for mounting the second member 370 on the inner wall of a vacuum cleaner nozzle (not shown) through engagement with a clip or other structure (not shown) on the nozzle wall. The second member also includes annular structure 384 within the outer annular wall portion 374 defining a pocket 382 for receiving the bearing 372 in frictional engagement. The end flange 376 mounts an inner annular wall portion 386 which cooperates with the outer annular wall portion 374 to define an annular channel 388. When the brushroll is assembled by pressing the spindle 320, the first member 340, the bearing 372 and the second member 370 together, the annular skirt portion 344 of the first member 340 extends into the annular channel 388 defined by the second member 370 to form a labyrinth seal.

The insert 400 is provided to stiffen the reduced diameter bearing-mounting portion 366 against bending due to the pull of the driving belt (not shown). The first member 340 includes a cavity 402 of circular cross-section passing through the stub portion 362 and a bore 404 of circular cross-section smaller than the cross-section of bore 402 passing from the stub portion 362 and extending within the bearing-mounting portion 366. The insert 400, which consists of a rolled strip of metal, is press fit into the second bore 404. The metal has a greater resistance to bending than the plastic from which the first member 340 is cast, and reinforces the first member 340 against bending near the bearing-mounting portion 366.

Figure 8:
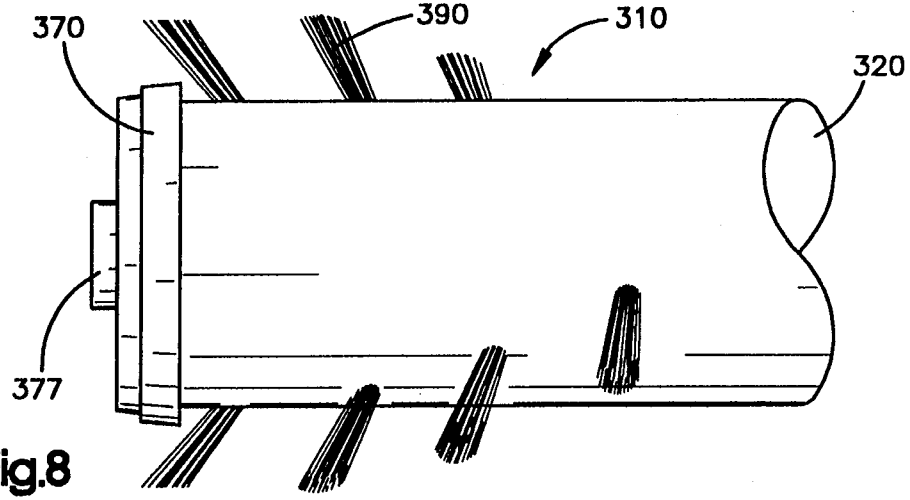
FIG. 8 is a side elevational view of one end of another brushroll.

As best shown in FIG. 8, the brushroll 310 includes tufts of bristles 390 arranged along two spiral paths on opposite sides of the spindle 320. The tufts 390 are angled toward the end of the spindle 320 in order to encourage the flow of threads toward that end. The angles which the tufts 390 make with the spindle 320 increase with distance from the center of the spindle 320, with tufts near the center being perpendicular or nearly perpendicular to the surface of the spindle 320 and tufts near the ends approaching an angle of 20°.

Figure 13:
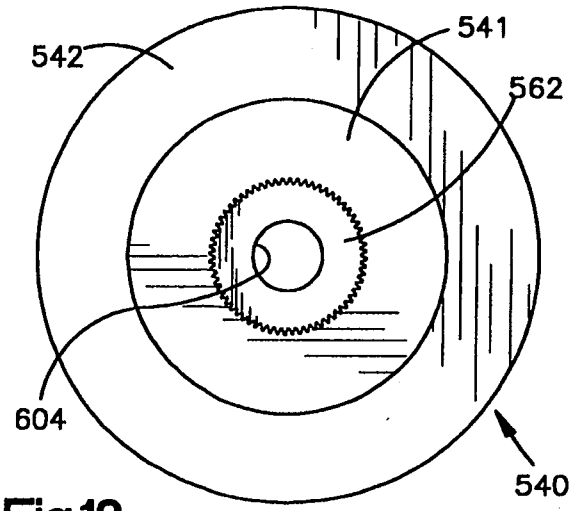
FIG. 13 is an elevational view of the first member of the brushroll shown in FIG. 12.
Figure 12:
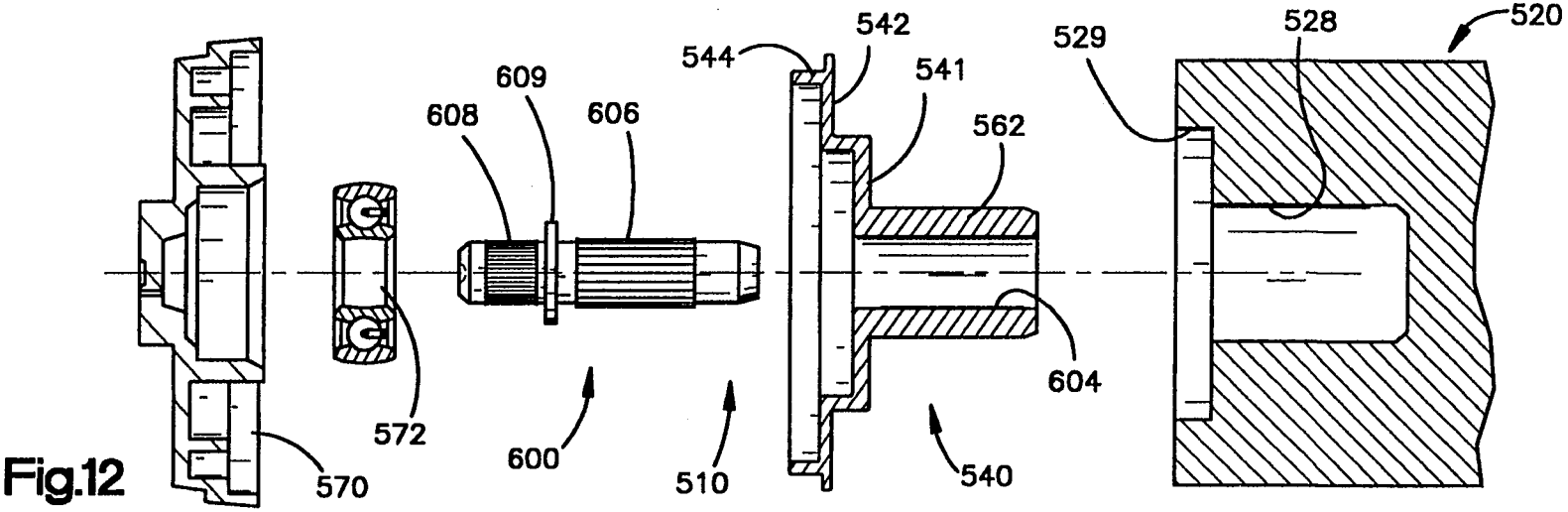
FIG. 12 is an exploded sectional view of another form of the brushroll of the invention.

An end of another form of brushroll 510 is shown in FIGS. 12 and 13. The outward appearance of the brushroll 510 is the same as that of the brushroll 310 shown in FIG. 8. In the brushroll 510, the stub shaft structure which couples the spindle 520 with a bearing 572 for support of the spindle 520 is a combination of structure on the first member 540 and a reinforcing shaft 600 which is frictionally engaged in the first member 540.

The brushroll 510 includes the spindle 520, the first member 540, a second member 570, a bearing 572 and an reinforcing shaft 600. The first member 540 is an integral plastic casting including a stub portion 562 for close-fitting engagement with the hole 528 in an end of the spindle, an inner flange portion 541 for fitting into a cavity in the end of the spindle 520, an outer flange portion 542 and a peripheral skirt 544. The stub portion 562 is knurled to increase the frictional engagement of the first member 540 with the spindle 520 and the end of the stub portion 562 is chamfered to help center it in the hole 528. The second member 570 is identical in structure to the second member 370 shown in FIGS. 9 and 11.

The two parts of the stub shaft structure 562, 600 cooperate to engage and support the spindle 520. The first member 540 includes a through bore 604 for receiving the reinforcing shaft insert 600. The reinforcing shaft 600 includes an insert portion 606 for making a press fit in the bore 604, a bearing-mounting portion 608 for engagement with the bearing 572 and a collar 609 separating the insert and baring-mounting portions 606, 608. The insert portion 606 extends within the hole 528 in the spindle 520 when the stub portion 562 of the first member 540 is pressed into the hole 528. The reinforcing shaft 600 is made from metal which has a greater resistance to bending than the plastic from which the first member 540 is cast, and increases the bending load which the end assembly can withstand. The insert and shaft portions 606, 608 .are each knurled for greater frictional engagement with the first member 540 and the bearing 572.

Figure 16:
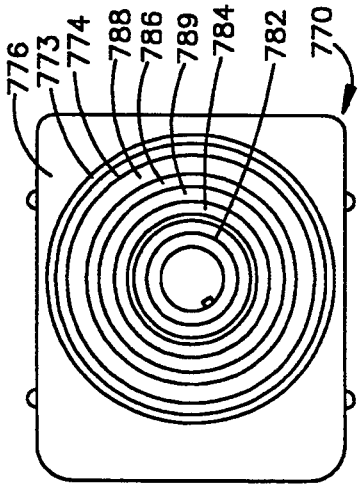
FIG. 16 is an elevational view of a second member of the brushroll of FIG. 14.
Figure 15:
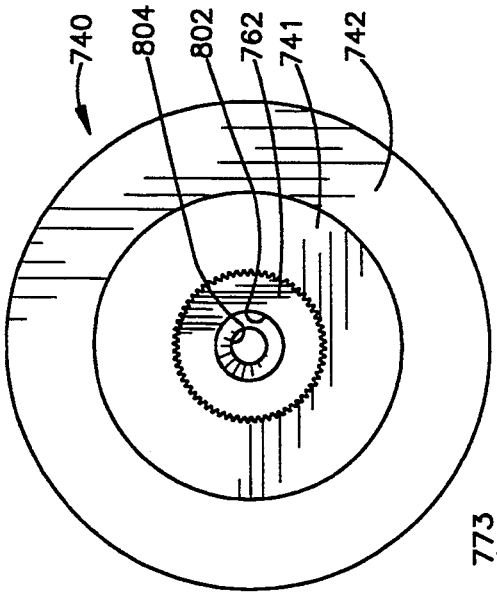
FIG. 15 is an elevational view of a first member of the brushroll of FIG. 14.
Figure 14:
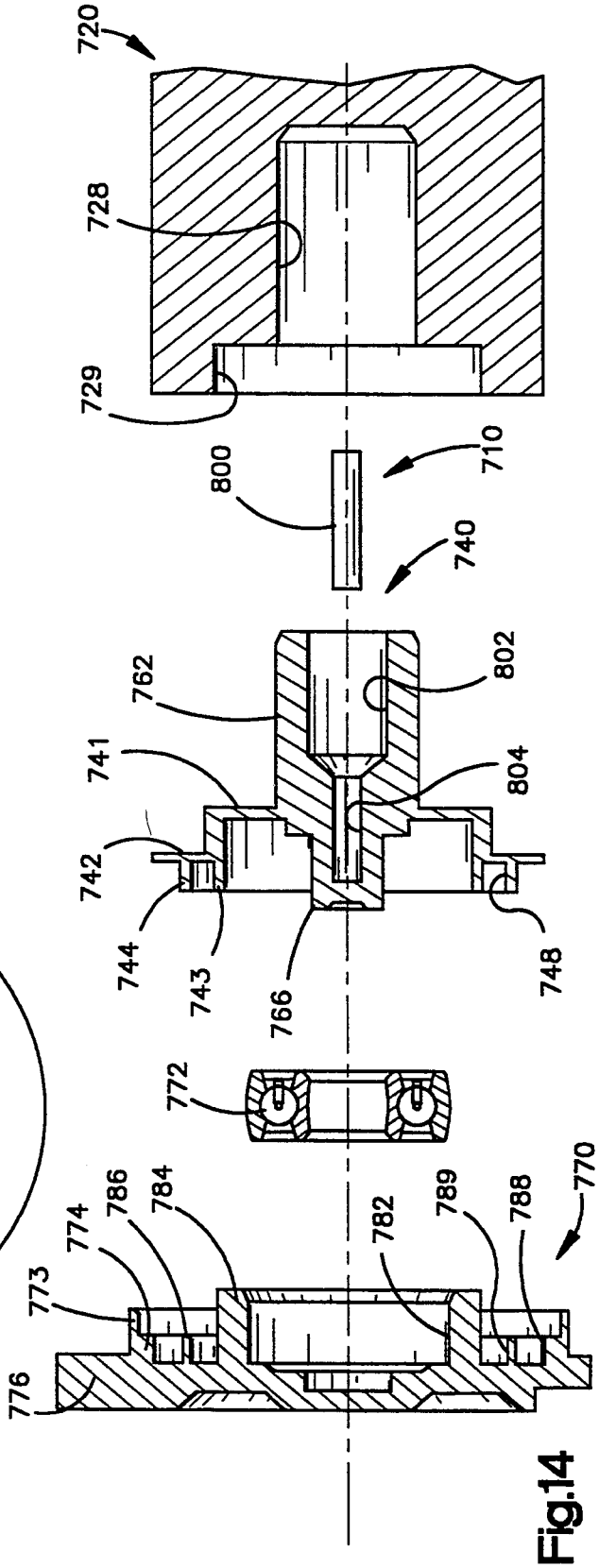
FIG. 14 is an exploded sectional view of another form of the brushroll of the invention.

An end of a another form of brushroll 710 is shown in FIGS. 14, 15 and 16. Like the brushroll 310 of FIG. 9, the stub shaft structure of the brushroll 710 forms a part of an integral first member. The modified brushroll 710 comprises a spindle 720, a first member 740, a second member 770, a bearing 772 and a reinforcing pin insert 800. The first member 740 is an integral plastic casting including a stub portion 762 for close-fitting engagement with a hole 728 in an end of the spindle 720, an inner flange portion 741 which is positioned in a cavity 729 in the end of the spindle 720, an outer flange portion 742, two skirts 743 and 744 defining a channel 748, and a bearing-mounting portion or neck 7.66 for engaging the bearing 772. The stub portion 762 and bearing-mounting portion 766 are knurled to increase the frictional engagement of the first member 740 with the spindle 720 and the bearing 772, and the stub portion 762 is chamfered to help center the stub portion 762 in the hole 728 as the brushroll is assembled.

The second member 770 includes an outer lip portion 773, an outer annular wall portion 774, an end flange portion 776 for engagement with slots on the inner wall of a vacuum cleaner nozzle (not shown) for supporting the brushroll 710, annular structure 784 for defining a bearing-receiving pocket 782 and an inner annular wall portion 786. The inner and outer annular wall portions 774, 786 cooperate to define a first annular channel 788 in the second member 770, while the inner annular wall portion 786 and the annular structure 784 cooperate to define a second annular channel 789 in the second member 770.

The first and second members 740, 770 form a labyrinth seal which requires threads, dirt and lint to make several changes of direction before the bearing 772 may be reached. When assembled, the skirts 743, 744 of the first member 740 extend into the channels 788, 789 defined by the second member 770. At the same time, the inner annular wall portion 786 of the second member 770 extends into the channel 748 defined by the first member 740. The intricate path through the labyrinth seal formed by the first and second members 740, 770 increases the likelihood that the bearing 772 will remain free of threads, dirt and lint because greater energy is required for the dirt to traverse the seal.

The insert 800 is provided to stiffen the bearing-mounting portion 766 against bending due to the pull of the driving belt (not shown). The first member 740 includes a cavity 802 of circular cross-section passing through the stub portion 762 and a bore 804 of circular cross-section smaller than the cross-section of bore 802 passing from the stub portion 762 and extending within the bearing-mounting portion 766. The insert 800, which consists of a rolled strip of metal, is press fit into the second bore 804. The metal has a greater resistance to bending than the plastic from which the first member 740 is cast, and reinforces the first member 740 against bending near the bearing-mounting portion 766.

Figure 17:
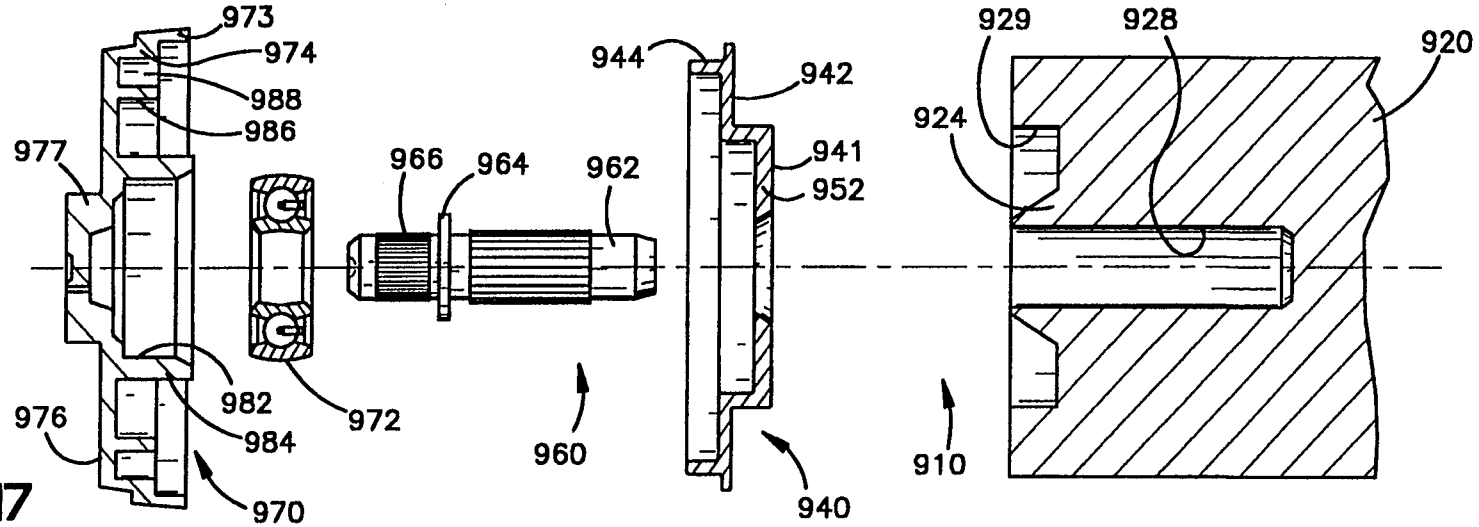
FIG. 17 is an exploded sectional view of another form of the brushroll of the invention.

Another form of brushroll 910 is shown in FIG. 17. The external appearance of the modified brushroll 910 is identical to that of the brushroll 310 of FIG. 8. It comprises a spindle 920, the first member 940, a stub shaft 960, a second member 970 and a bearing 972. The first member 940 is an plastic molding including an inner flange portion 941, an outer flange portion 942 and a peripheral skirt 944. The first member 940 also includes a hole 952 through the center of the inner flange.

Figure 18:
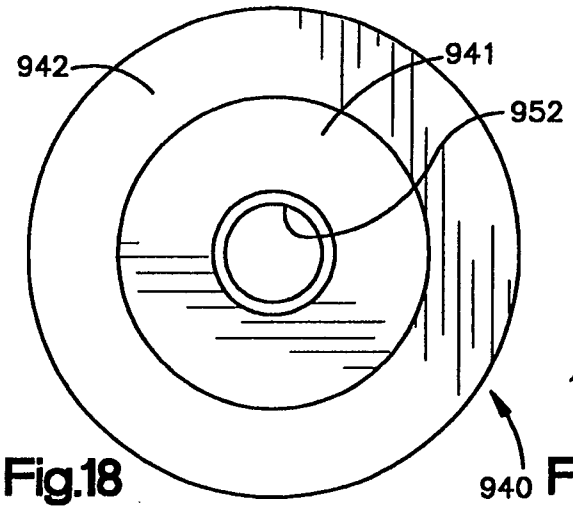
FIG. 18 is an elevational view of a first member of the brushroll of FIG. 17.

The spindle 920 is designed to frictionally retain the first member 940. It has cavity a 929 in each end (only one shown) into which the inner flange 941 of the first member 940 is inserted. At the center of the cavity 929 is a projection 924 which frictionally engages the hole 952 in the center of the first member 940 to retain the first member 940 on the end of the spindle 920. As shown in FIGS. 17 and 18, the sides of the hole 952 are tapered to match the taper of the conical projection 924. Though the friction between the sides of the hole 952 and the conical projection 924 should be sufficient to retain the first member 940, additional fasteners such as tacks (not shown) may be used to further secure the first member 940.

The stub shaft 960 includes a stub portion 962, a collar 964 and a bearing-mounting portion 966 which is fixed to the bearing 972. The stub portion 962 frictionally engages within an axial hole 928 through the conical projection 924 of the spindle 920. The stub portion 962 and bearing-mounting portion 966 are knurled, and the stub portion 962 is chamfered to help center the stub portion 962 in the hole 928 as the brushroll is assembled. When assembled, the collar 964 rests against the apex of the conical projection 924 to control the insertion depth of the stub shaft 960 in the hole 928. The first member 940 is retained on the end of the spindle 920 without contact with the collar 964 of the stub shaft 960.

Figure 9:
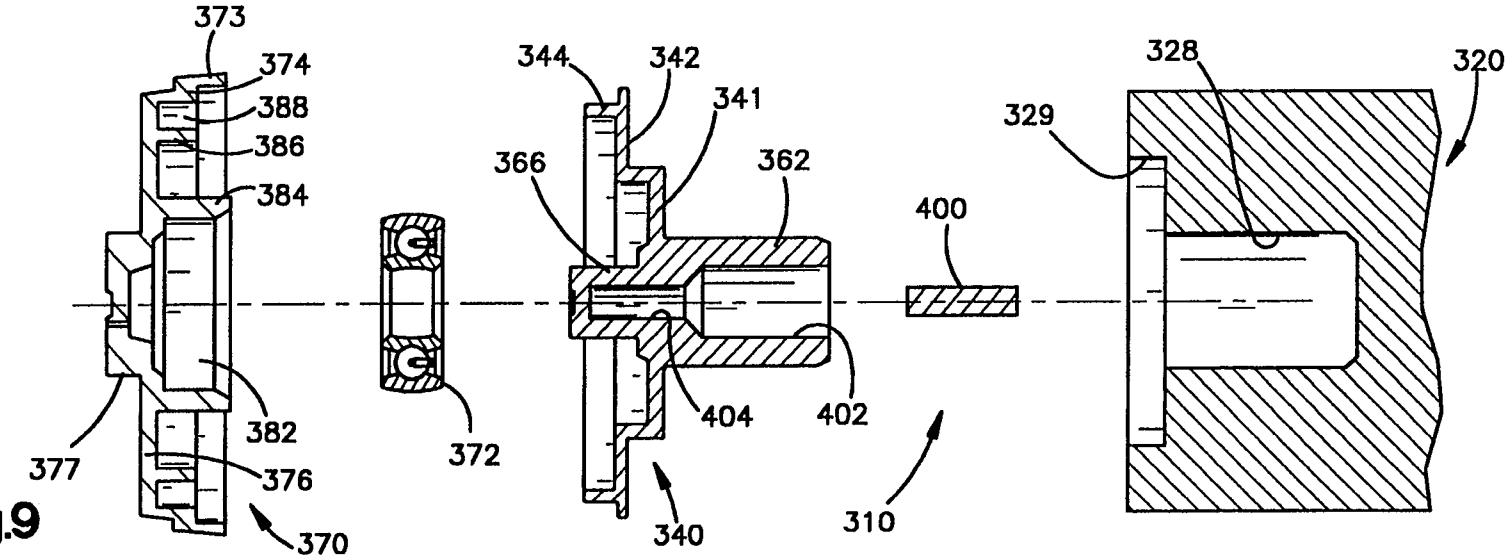
FIG. 9 is an exploded sectional view of one end of the brushroll of FIG. 8.
Figure 11:
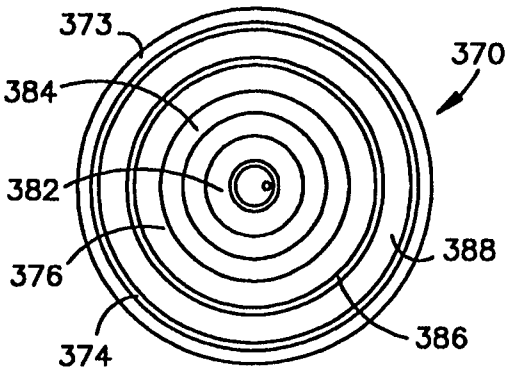
FIG. 11 is an elevational view of a second member of the brushroll shown in FIG. 9.
Figure 10:
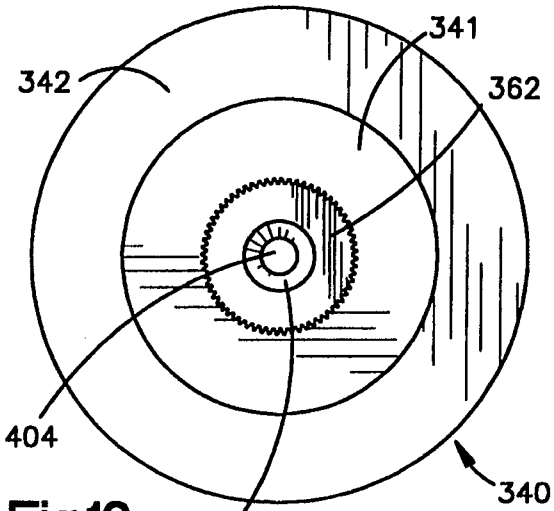
FIG. 10 is an elevational view of a first member of the brushroll shown in FIG. 9.

The second member 970, which is circular in shape transverse to the section shown, is identical in structure to the second member 370 shown in FIGS. 9 and 11. It includes an outer lip portion 973, an outer annular wall portion 974, a flange portion 976, an inner annular wall portion 986 and annular structure 984 defining a bearing-receiving pocket 982 for frictional engagement with the bearing 972. The inner and outer annular wall portions 974, 986 define an annular channel 988 into which the peripheral skirt 944 of the first member 940 extends to form a labyrinth seal. The end flange portion 976 includes means 977 for mounting the second member 970 on the inner wall of a vacuum cleaner nozzle (not shown) through engagement with a clip or other structure (not shown) on the nozzle wall.

Figure 19:
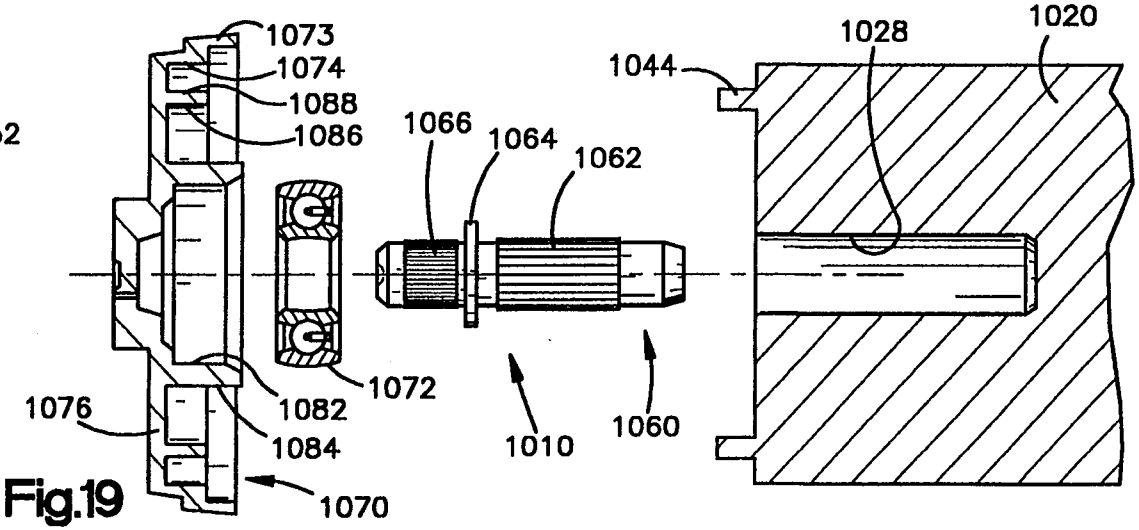
FIG. 19 is an exploded sectional view of another form of the brushroll of the invention.

An end of another form of brushroll 1010 is shown in FIG. 19. The external appearance of the brushroll 1010 is identical to that of the brushroll 310 of FIG. 8. It comprises a spindle 1020, a stub shaft 1060, an end member 1070 corresponding to the second members of previous embodiments and a bearing 1072. The ends of the spindle 1020, which is formed of injection molded plastic, include integral annular skirts 1044 (only one shown). (Alternatively, the skirt 1044 may take the form of a ring insert (not shown) projecting from an annular slot (not shown)in the end of the spindle 1020.)

Unlike previous embodiments, the spindle 1020 itself cooperates with the end member 1070 to define a labyrinth bearing seal. The end member 1070, which is circular in shape transverse to the section shown, is identical in structure to the second member 370 shown in FIGS. 9 and 11. It includes an outer lip portion 1073, an outer annular wall portion 1074, a flange portion 1076, an inner annular wall portion 1086 and annular structure 1084 defining a bearing-receiving pocket 1082. The inner and outer annular wall portions 1074, 1086 define an annular channel 1088 into which the integral skirt 1044 of the spindle 1020 extends to form the labyrinth seal. Since the skirt 1044 projects from the end of the spindle 1020 itself, there is no need for a separate component corresponding to the first member of previous embodiments.

The stub shaft 1060 includes a stub portion 1062, a collar 1064 and a bearing-mounting portion 1066 which is fixed to the bearing 1072. The stub portion 1062 frictionally engages within an axial hole 1028 in the end of the spindle 1020. The stub portion 1062 and bearing-mounting portion 1066 are knurled, and the stub portion 1062 is chamfered to help center the stub portion 1062 in the hole 1028 as the brushroll 1010 is assembled. When assembled, the collar 1064 rests against the end of the spindle 1020 and acts as a spacer to position the bearing 1072 relative to the spindle 1020.

Many variations and modifications of the invention will be apparent to those skilled in the art from the above detailed description. Therefore, it is to be understood that, within the scope of the appended claims, the invention can be practiced otherwise than as specifically shown and described.

I claim:

1. In a vacuum cleaner brushroll including a tufted spindle supported by end assemblies located at opposite ends of the spindle, said end assemblies rotatably mount the spindle in a vacuum cleaner nozzle whereby rotation of the spindle is effective to pick up debris that tends to move along the spindle toward the end assemblies, the improvement wherein each of said end assemblies comprises:

a first member fixed to an end of the spindle;

a second member rotatable relative to said first member, said second member having a bearing-receiving pocket and a portion that is adapted to mate with mounting structure in the vacuum cleaner nozzle;

stub shaft structure extending axially inward of said first member into fixed frictional engagement with a surface defining a hole in the end of the spindle;

a bearing having a first portion fixed on said stub shaft structure and a second portion rotatable with respect to said first portion and fitted in said bearing-receiving pocket, and said members cooperating to define a thread seal to protect said bearing from debris picked up during rotation of the spindle, said stub shaft structure comprises a one-piece shaft extending through an opening in said first member, said one-piece shaft having one end portion engaged with the surface defining the hole in the end of the spindle, an opposite end portion on which said first portion of said bearing is mounted and a collar portion having a first surface for engaging one of the spindle and first member to control the depth of insertion of said one end portion of said one-piece shaft into the hole in the end of said spindle, said collar portion having another surface for engaging said first portion of said bearing to locate said bearing along said opposite end portion of said shaft.

2. The improvement of claim 1 wherein said one end portion of said one-piece shaft extends through an opening in said first member and wherein said first surface of said collar portion engages the spindle.

3. The improvement of claim 1 wherein said first surface of said collar portion of said one-piece shaft engages said first member.

4. In a vacuum cleaner brushroll including a tufted spindle supported by substantially identical end assemblies located at opposite ends of the spindle, said end assemblies rotatably mount the spindle in a vacuum cleaner nozzle whereby rotation of the spindle is effective to pick up debris that tends to move along the spindle towards the end assemblies, the improvement wherein each of said end assemblies comprises:

a first member abutting an end of the spindle and rotatable therewith, said first member having an opening;

a shaft having a first end portion extending through said opening in said first member and into fixed frictional engagement about its circumferential periphery with a surface defining a hole in the end of the spindle, said shaft having a second opposite end portion projecting from the end of the spindle, said shaft also having a collar which engages a portion of said first member and maintains said first member abutting the end of the spindle;

a second member rotatable relative to said first member and having a bearing-receiving pocket and a portion that is adapted to mate with mounting structure in the vacuum cleaner nozzle;

a bearing having a first bearing portion fixed on said second end portion of said shaft and a second bearing portion rotatable relative to said first bearing portion and fitted in said bearing-receiving pocket of said second member; and said first and second members interfitting to define a thread seal to protect said bearing from debris picked up during rotation of the spindle.

5. The improvement of claim 3 wherein said opening in said first member is located centrally therein and is adapted to be disposed coaxially with the hole in the end of the spindle.

* * * * *